US009949008B2

(12) United States Patent
Hviid

(10) Patent No.: US 9,949,008 B2
(45) Date of Patent: Apr. 17, 2018

(54) REPRODUCTION OF AMBIENT ENVIRONMENTAL SOUND FOR ACOUSTIC TRANSPARENCY OF EAR CANAL DEVICE SYSTEM AND METHOD

(71) Applicant: BRAGI GmbH, München (DE)

(72) Inventor: Nikolaj Hviid, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/244,958

(22) Filed: Aug. 23, 2016

(65) Prior Publication Data

US 2017/0064426 A1 Mar. 2, 2017

Related U.S. Application Data

(60) Provisional application No. 62/211,732, filed on Aug. 29, 2015.

(51) Int. Cl.
*H04R 25/00* (2006.01)
*H04R 1/10* (2006.01)

(52) U.S. Cl.
CPC ..... *H04R 1/1016* (2013.01); *H04R 1/1075* (2013.01); *H04R 1/1091* (2013.01); *H04R 2460/05* (2013.01)

(58) Field of Classification Search
CPC combination set(s) only.
See application file for complete search history.

(56) References Cited

U.S. PATENT DOCUMENTS 3,934,100 A 1/1976 Harada
4,150,262 A 4/1979 Ono
4,334,315 A 6/1982 Ono et al.
(Continued)

FOREIGN PATENT DOCUMENTS

EP 1017252 A2 7/2000
GB 2074817 4/1981
(Continued)

OTHER PUBLICATIONS

Announcing the $3,333,333 Stretch Goal (Feb. 24, 2014).
(Continued)

*Primary Examiner* — Amir Etesam
(74) *Attorney, Agent, or Firm* — Goodhue, Coleman & Owens, P.C.

(57) ABSTRACT

An ear piece for use by an individual having an external auditory canal includes an earpiece housing configured for placement within the external auditory canal of the individual, a processor disposed within the ear piece housing, at least one microphone disposed within the earpiece housing wherein the at least one earpiece is positioned to detect ambient environmental sound, and at least one speaker disposed within the earpiece housing. The ear piece is configured to detect ambient environmental sound proximate the external auditory canal of the individual using the at least one microphone and reproduce the ambient environmental sound at the at least one speaker within the earpiece housing. The processor is further configured to modify the ambient environmental sound based on shape of the external auditory canal such that audio perception of the ambient environmental sound is as if the ear piece was not present.

15 Claims, 4 Drawing Sheets

(56) References Cited

U.S. PATENT DOCUMENTS

| | | | |
|---|---|---|---|
| 4,375,016 | A | 2/1983 | Harada |
| 4,588,867 | A | 5/1986 | Konomi |
| 4,654,883 | A | 3/1987 | Iwata |
| 4,682,180 | A | 7/1987 | Gans |
| 4,791,673 | A | 12/1988 | Schreiber |
| 4,865,044 | A | 9/1989 | Wallace et al. |
| 5,191,602 | A | 3/1993 | Regen et al. |
| 5,201,007 | A | 4/1993 | Ward et al. |
| 5,280,524 | A | 1/1994 | Norris |
| 5,295,193 | A | 3/1994 | Ono |
| 5,298,692 | A | 3/1994 | Ikeda et al. |
| 5,343,532 | A | 8/1994 | Shugart |
| 5,363,444 | A | 11/1994 | Norris |
| 5,497,339 | A | 3/1996 | Bernard |
| 5,606,621 | A | 2/1997 | Reiter et al. |
| 5,613,222 | A | 3/1997 | Guenther |
| 5,692,059 | A | 11/1997 | Kruger |
| 5,721,783 | A | 2/1998 | Anderson |
| 5,749,072 | A | 5/1998 | Mazurkiewicz et al. |
| 5,771,438 | A | 6/1998 | Palermo et al. |
| 5,802,167 | A | 9/1998 | Hong |
| 5,929,774 | A | 7/1999 | Charlton |
| 5,933,506 | A | 8/1999 | Aoki et al. |
| 5,949,896 | A | 9/1999 | Nageno et al. |
| 5,987,146 | A | 11/1999 | Pluvinage et al. |
| 6,021,207 | A | 2/2000 | Puthuff et al. |
| 6,054,989 | A | 4/2000 | Robertson et al. |
| 6,081,724 | A | 6/2000 | Wilson |
| 6,094,492 | A | 7/2000 | Boesen |
| 6,111,569 | A | 8/2000 | Brusky et al. |
| 6,112,103 | A | 8/2000 | Puthuff |
| 6,157,727 | A | 12/2000 | Rueda |
| 6,167,039 | A | 12/2000 | Karlsson et al. |
| 6,181,801 | B1 | 1/2001 | Puthuff et al. |
| 6,208,372 | B1 | 3/2001 | Barraclough |
| 6,275,789 | B1 | 8/2001 | Moser et al. |
| 6,339,754 | B1 | 1/2002 | Flanagan et al. |
| 6,408,081 | B1 | 6/2002 | Boesen |
| D464,039 | S | 10/2002 | Boesen |
| 6,470,893 | B1 | 10/2002 | Boesen |
| D468,299 | S | 1/2003 | Boesen |
| D468,300 | S | 1/2003 | Boesen |
| 6,542,721 | B2 | 4/2003 | Boesen |
| 6,560,468 | B1 | 5/2003 | Boesen |
| 6,654,721 | B2 | 11/2003 | Handelman |
| 6,664,713 | B2 | 12/2003 | Boesen |
| 6,694,180 | B1 | 2/2004 | Boesen |
| 6,718,043 | B1 | 4/2004 | Boesen |
| 6,738,485 | B1 | 5/2004 | Boesen |
| 6,748,095 | B1 | 6/2004 | Goss |
| 6,754,358 | B1 | 6/2004 | Boesen et al. |
| 6,784,873 | B1 | 8/2004 | Boesen et al. |
| 6,823,195 | B1 | 11/2004 | Boesen |
| 6,852,084 | B1 | 2/2005 | Boesen |
| 6,879,698 | B2 | 4/2005 | Boesen |
| 6,892,082 | B2 | 5/2005 | Boesen |
| 6,920,229 | B2 | 7/2005 | Boesen |
| 6,952,483 | B2 | 10/2005 | Boesen et al. |
| 6,987,986 | B2 | 1/2006 | Boesen |
| 7,136,282 | B1 | 11/2006 | Rebeske |
| 7,203,331 | B2 | 4/2007 | Boesen |
| 7,209,569 | B2 | 4/2007 | Boesen |
| 7,215,790 | B2 | 5/2007 | Boesen et al. |
| 7,463,902 | B2 | 12/2008 | Boesen |
| 7,508,411 | B2 | 3/2009 | Boesen |
| 7,983,628 | B2 | 7/2011 | Boesen |
| 8,140,357 | B1 | 3/2012 | Boesen |
| 2001/0005197 | A1 | 6/2001 | Mishra et al. |
| 2001/0027121 | A1 | 10/2001 | Boesen |
| 2001/0056350 | A1 | 12/2001 | Calderone et al. |
| 2002/0002413 | A1 | 1/2002 | Tokue |
| 2002/0007510 | A1 | 1/2002 | Mann |
| 2002/0010590 | A1 | 1/2002 | Lee |
| 2002/0030637 | A1 | 3/2002 | Mann |
| 2002/0046035 | A1 | 4/2002 | Kitahara et al. |
| 2002/0057810 | A1 | 5/2002 | Boesen |
| 2002/0076073 | A1 | 6/2002 | Taenzer et al. |
| 2002/0118852 | A1 | 8/2002 | Boesen |
| 2003/0065504 | A1 | 4/2003 | Kraemer et al. |
| 2003/0100331 | A1 | 5/2003 | Dress et al. |
| 2003/0104806 | A1 | 6/2003 | Ruef et al. |
| 2003/0115068 | A1 | 6/2003 | Boesen |
| 2003/0125096 | A1 | 7/2003 | Boesen |
| 2003/0218064 | A1 | 11/2003 | Conner et al. |
| 2004/0070564 | A1 | 4/2004 | Dawson et al. |
| 2004/0160511 | A1 | 8/2004 | Boesen |
| 2005/0043056 | A1 | 2/2005 | Boesen |
| 2005/0125320 | A1 | 6/2005 | Boesen |
| 2005/0148883 | A1 | 7/2005 | Boesen |
| 2005/0165663 | A1 | 7/2005 | Razumov |
| 2005/0196009 | A1 | 9/2005 | Boesen |
| 2005/0251455 | A1 | 11/2005 | Boesen |
| 2005/0266876 | A1 | 12/2005 | Boesen |
| 2006/0029246 | A1 | 2/2006 | Boesen |
| 2006/0074671 | A1 | 4/2006 | Farmaner et al. |
| 2006/0074808 | A1 | 4/2006 | Boesen |
| 2008/0254780 | A1 | 10/2008 | Kuhl et al. |
| 2011/0103610 | A1* | 5/2011 | Harsch ..... H04R 1/1016 381/74 |
| 2014/0247957 | A1* | 9/2014 | Hagedorn-Olsen .. H04R 25/654 381/328 |
| 2016/0014515 | A1* | 1/2016 | Boesen ..... H04M 1/05 381/309 |
| 2016/0157027 | A1* | 6/2016 | Hug ..... H04R 25/48 381/351 |
| 2017/0064460 | A1 | 3/2017 | Hviid et al. |

FOREIGN PATENT DOCUMENTS

| | | |
|---|---|---|
| JP | 06292195 | 10/1998 |
| WO | 2014043179 A2 | 3/2014 |
| WO | 2015110577 A1 | 7/2015 |
| WO | 2015110587 A1 | 7/2015 |

OTHER PUBLICATIONS

BRAGI is on Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).
BRAGI Update—Memories From the First Month of Kickstarter—Update on Progress (Aug. 1, 2014).
BRAGI Update—Memories From the Second Month of Kickstarter—Update on Progress (Aug. 22, 2014).
BRAGI Update—New People @BRAGI—Prototypes (Jun. 26, 2014).
BRAGI Update—Office Tour, Tour to China, Tour to CES (Dec. 11, 2014).
BRAGI Update—Status on Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back to China, Backer Day, On Track(May 16, 2015).

(56) References Cited

OTHER PUBLICATIONS

BRAGI Update—Beta2 Production and Factory Line(Aug. 20, 2015).
BRAGI Update—Certifications, Production, Ramping Up (Nov. 13, 2015).
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2014).
BRAGI Update—On Track, Design Verification, How It Works and What's Next(Jul. 15, 2015).
BRAGI Update—On Track, On Track and Gems Overview (Jun. 24, 2015).
BRAGI Update—Status on Wireless, Supply, Timeline and Open House@BRAGI(Apr. 1, 2015).
BRAGI Update13 Unpacking Video, Reviews on Audio Perform and Boy Are We Getting Close(Sep. 10, 2015).
Last Push Before the Kickstarter Campaign Ends on Monday 4pm CET (Mar. 28, 2014).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for the Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).

* cited by examiner

REPRODUCTION OF AMBIENT ENVIRONMENTAL SOUND FOR ACOUSTIC TRANSPARENCY OF EAR CANAL DEVICE SYSTEM AND METHOD

PRIORITY STATEMENT

This application claims priority to U.S. Provisional Patent Application No. 62/211,732, filed Aug. 29, 2016, hereby incorporated by reference in its entirety.

FIELD OF THE INVENTION

The present invention relates to wearable devices. More particularly, but not exclusively, the present invention relates to ear canal devices.

BACKGROUND OF THE ART

The use of ear canal devices is becoming increasingly prevalent. Ear canal devices are gaining recognition for their ability to provide a stable platform for the transmission of sound to the individual from many types of linked devices including, without limitation, phones, portable music players, watches and computers among others. Further, the ear canal has been recognized as a rich area for the monitoring of many biometric parameters. Pulse oximetry, temperature, heart rate, speed and pace are several examples of data that can be tracked or monitored from ear canal devices.

Additionally, they have the advantage of relatively stable positioning on the user, and are subject to less movement variation than sensor arrays that would be worn elsewhere, such as on the wrist. However, the use of these devices can become problematic for the user, as they can cause a decrease in auditory acuity due to their position at the ear canal. Thus, there is a need to restore auditory transparency when using ear canal devices.

SUMMARY

Therefore, it is a primary object, feature, or advantage to improve over the state of the art.

It is a further object, feature, or advantage to restore audio transparency when using ear canal devices.

A still further object, feature, or advantage of the present invention is to provide for the ability to use external microphone or microphones to detect ambient environmental sound.

Another object, feature, or advantage of the present invention is to account for the sound shaping characteristics of the external auditory canal.

Yet another object, feature, or advantage of the present invention is to present the signal through the microphone located in the external auditory canal nearest the tympanic membrane to allow the user to perceive acoustic stimuli in such a fashion that the device is acoustically transparent.

Another object, feature, or advantage is to avoid the need to accept diminished auditory inputs at the level of the external auditory canal.

One or more of these and/or other objects, features, or advantages of the present invention will become apparent from the specification and claims that follow. No single embodiment need exhibit each and every object, feature, or advantage. It is contemplated that different embodiments may have different objects, features, or advantages.

According to one aspect, an ear piece for use by an individual having an external auditory canal is provided. The earpiece includes an earpiece housing configured for placement within the external auditory canal of the individual, a processor disposed within the ear piece housing, at least one microphone disposed within the earpiece housing wherein the at least one earpiece is positioned to detect ambient environmental sound, and at least one speaker disposed within the earpiece housing. The ear piece is configured to detect ambient environmental sound proximate the external auditory canal of the individual using the at least one microphone and reproduce the ambient environmental sound at the at least one speaker within the earpiece housing. The processor may be further configured to modify the ambient environmental sound based on shape of the external auditory canal such that audio perception of the ambient environmental sound is as if the ear piece was not present. The ear piece housing may be water resistant. The at least one speaker may be positioned at the external auditory canal proximate a tympanic membrane of the individual. The ear piece may further include at least one biological sensor operatively connected to the processor. The at least one biological sensor may include a pulse oximeter and/or temperature sensor.

According to another aspect, a method for an ear canal device is provided. The method includes providing an ear piece for use by an individual having an external auditory canal, the ear piece comprising an earpiece housing configured for placement within the external auditory canal of the individual, a processor disposed within the ear piece housing, at least one microphone disposed within the earpiece housing wherein the at least one earpiece is positioned to detect ambient environmental sound, and at least one speaker disposed within the earpiece housing. The method may further include detecting ambient environmental sound proximate the external auditory canal of the individual using the at least one microphone and reproducing at the ambient environmental sound at the at least one speaker within the earpiece housing to thereby provide for audio transparency. The method may further include modifying the ambient environmental sound based on shape of the external audio canal of the individual. The reproducing may occur at the speaker nearest a tympanic membrane of the individual. The ear piece may further include a biological sensor and the method may further provide for sensing a biological parameter using the biological sensor. The biological sensor may be a pulse oximeter, temperature sensor, or other type of biological sensor.

DETAILED DESCRIPTION

To restore auditory transparency when using ear canal devices through the use of at least one external facing microphone to detect incoming auditory stimuli. Said incoming auditory signal can be shaped to account for the characteristics of each user's external auditory canal. Sound would then be presented to the tympanic membrane via a speaker present in the user's external auditory canal. This renders the ear canal device acoustically transparent. The user's bearing is unaffected, and auditory perception is as if the device wasn't physically present at the ear canal.

Figure 1:
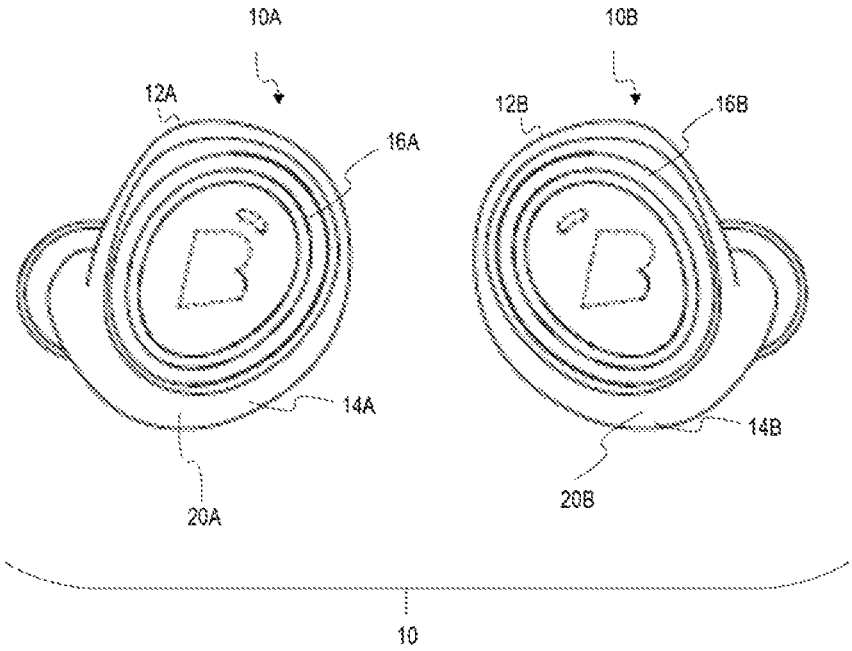
FIG. 1 illustrates one example of a wearable device in the form of a set of earpieces.

FIG. 1 illustrates one example of a wearable device in the form of a set of earpieces 10 including a left ear piece 12A and a right earpiece 12B. Each of the ear pieces 12A, 12B has a housing 14A, 14B which may be in the form of a protective shell or casing and may he an in-the-ear earpiece housing. Note that when each of the earpieces 12A, 12B is placed within a corresponding external auditory canal the external auditory canal of the user would be physically blocked, and not open. Thus, the user would not conventionally be able to hear ambient noise. Although perhaps appropriate for use in a hearing aid, this blocking of ambient environmental sound is problematic.

Figure 2:
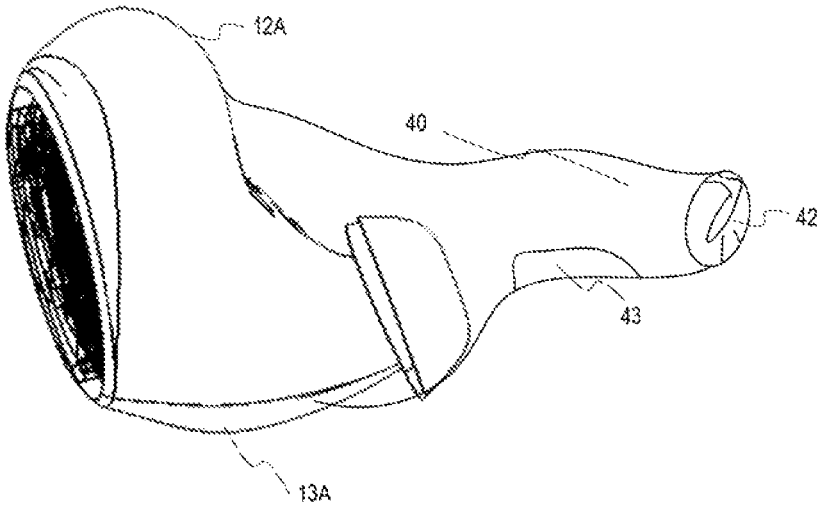
FIG. 2 illustrates one example of an ear piece positioned within an external auditory canal of an individual.

FIG. 2 illustrates an ear piece 12A inserted into an ear of an individual or user. The ear piece 12A fits at least partially into the external auditory canal 40 of the individual. A tympanic membrane 42 is shown at the end of the external auditory canal 40. The earpiece 12A has a sleeve 13A on the earpiece. The sleeve may be formed of silicone or other material which is safe for an individual to wear and which improves comfort for the user. The sleeve may be in any number of sizes including, extra small, small, medium, and large.

Figure 3:
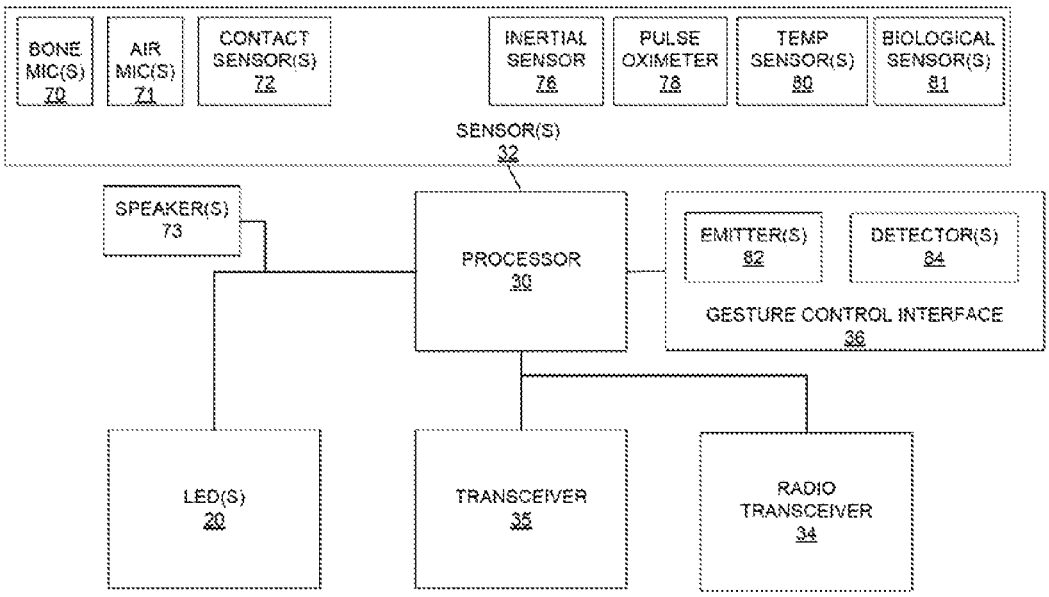
FIG. 3 is a block diagram illustrating one example of a device.

FIG. 3 is a block diagram illustrating a device. The device may include one or more LEDs 20 electrically connected to a processor 30. The processor 30 may also be electrically connected to one or more sensors 32. Where the device is an earpiece, the sensor(s) may include an inertial sensor 76, an accelerometer 74, one or more contact sensors 72, a bone conduction microphone or air conduction microphone 70, a pulse oximeter 76, a temperature sensor 80, or other biological sensors. A gesture control interface 36 is also operatively connected to the process 30. The gesture control interface 36 may include one or more emitters 82 and one or more detectors 84 for sensing user gestures. The emitters may he of any number of types including infrared LEDs. The device may include a transceiver 35 which may allow for induction transmissions such as through near field magnetic induction. A short range transceiver 34 using Bluetooth, UWB, or other means of radio communication may also be present. In operation, the processor 30 may be programed to convey different information using one or more of the LED(s) 20 based on context or mode of operation of the device. The various sensors 32, the processor 30, and other electronic components may be located on the printed circuit board of the device.

Figure 4:
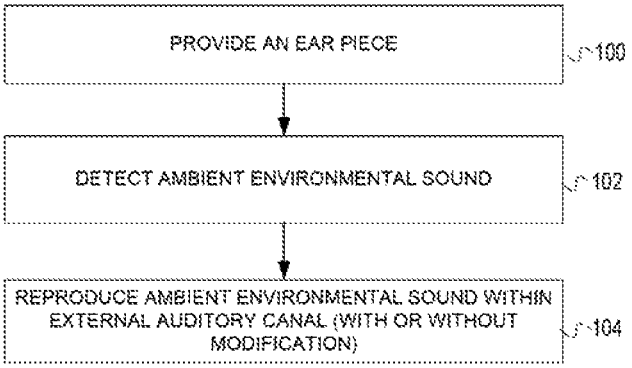
FIG. 4 illustrates one example of a method.

FIG. 4 illustrates one example of a method. As shown in FIG. 4, in step 100 an ear piece is produced. In step 102, the ambient environmental sound is detected. In step 104, the ambient environmental sound is reproduced within the external auditory canal with or without modification. Where the ambient environmental sound is reproduced with modification, the modification may take into account the size and shape of the external auditory canal of the individual in order to modify any received signal in a manner to best approximate or reproduce the sound as if heard directly by the user as opposed to having the sound sensed on one side of the ear piece (the external side) and reproduced at the other side of the ear piece (the inner side nearest the tympanic membrane). The sound processing performed by the ear piece may further take into consideration position of one or more microphones of the external earpiece as well.

Generally, the ear canal is about 2.5 cm (1 in) long and 0.7 cm (0.28 in) in diameter with a sigmoid form and runs from behind and above downward and forward, it has a generally oval cross-section. The size and shape of an external auditory canal of a user may be determined in any number of different ways. For example, sound signals may be emitted by a speaker and reflections of those sound signals may be detected by one or more microphones in order to map the size and shape of the external auditory canal such as by using shifts in frequency or delays. The size and shape of the external auditory canal may also be determined at least in part based on the size of the best fitting earpiece or an associated sleeve which fits around the earpiece. The size and shape of the external auditory canal may be also be determined based on direct measurement, photogrammetry, or other observation. In addition, the user may select different sizes and shapes for their external auditory canal. For example, the earpiece may cycle through a plurality of different size settings and modify a sound differently at each setting. The user may then select through voice command or through the user interface whether the setting or settings produce a better or worse reproduction of the sound in order to select the appropriate settings.

The ambient environmental sounds themselves may be modified in various ways based on the different external auditory canal sizes and shapes. For example, one or more sound filters may he associated with each setting or combination of settings. Alternatively, settings regarding ear canal size and shape may be used to parameterize other sound processing algorithms used in reproduction of the environmental sound.

Therefore, various examples of systems, devices, apparatus, and methods for restoring auditory transparency when using ear canal devices through the use of at least one external facing microphone to detect incoming auditory stimuli have been shown and described. Although various embodiments and examples have been set forth, resent invention contemplates numerous variations, options, and alternatives.

What is claimed is:

1. An ear piece for use by an individual having an external auditory canal, comprising:

an earpiece housing configured for placement within the external auditory canal of the individual;

a processor disposed within the earpiece housing;

at least one microphone disposed within the earpiece housing, wherein the at least one microphone is positioned to detect ambient environmental sound; and at least one speaker disposed within the earpiece housing;

wherein the ear piece is configured to detect ambient environmental sound proximate the external auditory canal of the individual using the at least one microphone;

wherein the processor is further configured to modify the ambient environmental sound based on shape of the external auditory canal such that audio perception of the ambient environmental sound is as if the ear piece was not present; and wherein the at least one speaker is configured to reproduce the ambient environmental sound.

2. The ear piece of claim 1 wherein the shape of the external auditory canal is determined at least in part based on a size of a sleeve for the ear piece.

3. The ear piece of claim 1 wherein the shape of the external auditory canal is determined by a user setting.

4. The ear piece of claim 1 wherein the earpiece housing is water resistant.

5. The ear piece of claim 1 wherein the at least one speaker is positioned at the external auditory canal proximate a tympanic membrane of the individual.

6. The ear piece of claim 1 further comprising at least one biological sensor operatively connected to the processor.

7. The ear piece of claim 4 wherein the at least one biological sensor comprises a pulse oximeter.

8. The ear piece of claim 4 wherein the at least one biological sensor comprises a temperature sensor.

9. The ear piece of claim 1 wherein the at least one speaker comprises a plurality of speakers.

10. The ear piece of claim 1 wherein the at least one microphone comprises a plurality of microphones.

11. A method for an ear canal device, the method comprising:

providing an ear piece for use by an individual having an external auditory canal, the ear piece comprising an earpiece housing configured for placement within the external auditory canal of the individual, a processor disposed within the earpiece housing, at least one microphone disposed within the earpiece housing positioned to detect ambient environmental sound, and at least one speaker disposed within the earpiece housing;

detecting ambient environmental sound proximate the external auditory canal of the individual using the at least one microphone;

modifying the ambient environmental sound based on shape of the external auditory canal of the individual; and reproducing the ambient environmental sound at the at least one speaker within the earpiece housing to provide audio transparency.

12. The method of claim 9 wherein the reproducing of the ambient environmental sound occurs at the at least one speaker nearest a tympanic membrane of the individual.

13. The method of claim 9 further comprising sensing a biological parameter using the biological sensor, wherein the biological parameter is sensed by a biological sensor operatively connected to the processor of the ear piece.

14. The method of claim 11 wherein the biological sensor comprises a pulse oximeter.

15. The method of claim 11 wherein the biological sensor comprises a temperature sensor.

* * * * *